US005529456A

United States Patent [19]

Luxem et al.

[11] Patent Number: 5,529,456

[45] **Date of Patent: *Jun. 25, 1996**

[54] DEVICE FOR UNITING A RESIDUE SHEET PILE AND A MAIN SHEET PILE

[75] Inventors: Heiner Luxem, Wilhelmsfeld; Michael Nübel, Holzgerlingen; Gerhard Pollich, Heidelberg; Erich M. Zahn, Eppelheim, all of Germany

[73] Assignee: Heidelberger Druckmaschinen AG, Heidelberg, Germany

[ * ] Notice: The term of this patent shall not extend beyond the expiration date of Pat. No. 5,242,261.

[21] Appl. No.: 338,891

[22] Filed: Nov. 14, 1994

Related U.S. Application Data

[63] Continuation of Ser. No. 210,070, Mar. 17, 1994, abandoned, which is a continuation of Ser. No. 939,453, Sep. 2, 1992, abandoned.

[30] Foreign Application Priority Data

Sep. 2, 1991 [DE] Germany ..... 41 29 165.4

[51] Int. Cl.[6] ..... B65H 3/00

[52] U.S. Cl. ..... 414/795.8; 271/158

[58] Field of Search ..... 271/157, 158, 271/159; 414/795.8

[56] References Cited

U.S. PATENT DOCUMENTS

| | | | |
|---|---|---|---|
| 2,336,839 | 12/1943 | Blackstone | 271/158 |
| 2,589,428 | 3/1952 | Pearce | 271/159 |
| 2,958,527 | 11/1960 | Seel | 271/158 |
| 3,180,638 | 4/1965 | Meylan | 271/159 |
| 3,369,805 | 2/1968 | Pierson et al. | 271/158 |
| 3,975,011 | 8/1976 | Marass | 271/157 |
| 4,681,502 | 7/1987 | Stafner | 271/157 |
| 5,011,126 | 4/1991 | Suzuki et al. | 271/159 |
| 5,096,372 | 3/1992 | Maejima | 271/158 |
| 5,116,041 | 5/1992 | Pollich | 271/158 |
| 5,242,261 | 9/1993 | Pollich et al. | 414/795.8 |

FOREIGN PATENT DOCUMENTS

| | | | |
|---|---|---|---|
| 1415298 | 9/1965 | France | 271/158 |
| 2505762 | 6/1976 | Germany | 271/159 |
| 1003262 | 9/1965 | United Kingdom | 271/159 |

*Primary Examiner*—H. Grant Skaggs
*Attorney, Agent, or Firm*—Herbert L. Lerner; Laurence A. Greenberg

[57] ABSTRACT

A device for uniting a residue sheet pile and a main sheet pile into an aggregate sheet pile wherein a lowermost sheet of the residue sheet pile rests upon and uppermost sheet of the main sheet pile includes a displacement device having a drive; and a rake displaceable by the displacement device along a displacement path in a pile slide-in direction from a first to a second position and from the second to the first position in a direction opposite to the slide-in direction. The residue sheet pile is seated with its undermost sheet on the rake in the second position thereof, and the main sheet pile is in engagement with the rake from below with the uppermost sheet thereof, in one phase of the pile uniting process. The rake has traversed the displacement path in the direction from the second to the first position thereof, in a final phase of the pile uniting process. The rake is formed of lattice bars having respective free ends extending in the slide-in-direction, and the free bar ends have a cross-section reducing in height substantially constantly in the slide-in direction; the reduction in cross section of the free ends of the lattice bars being such that when the residue sheet pile becomes seated on the lattice bars, a lateral face of the residue sheet pile extending in the slide-in direction is simultaneously lowered onto a reduced cross section of the lattice bars.

3 Claims, 13 Drawing Sheets

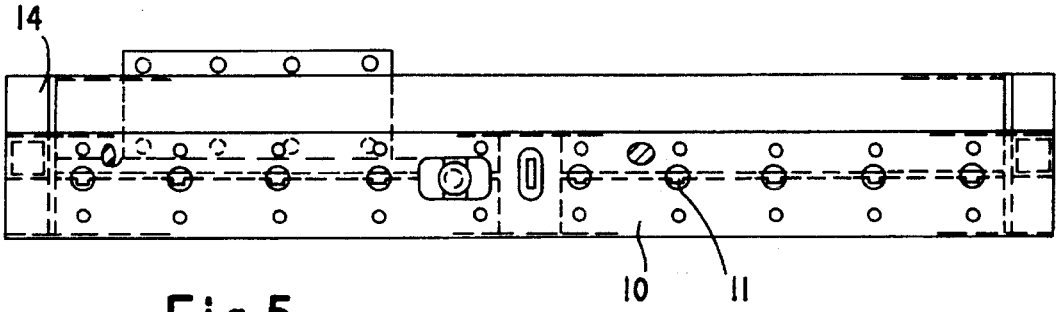
Fig.5
Fig.6
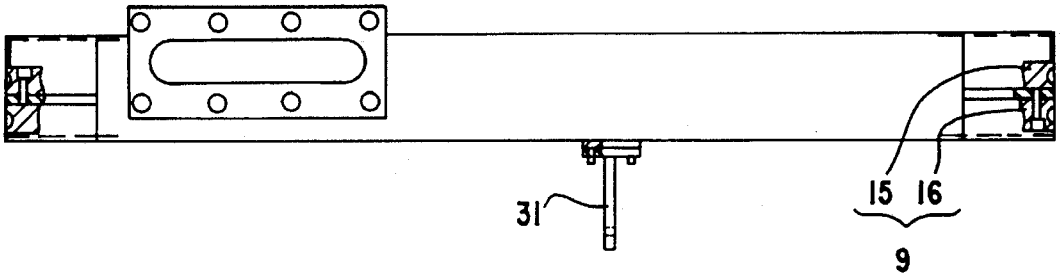

Fig.8
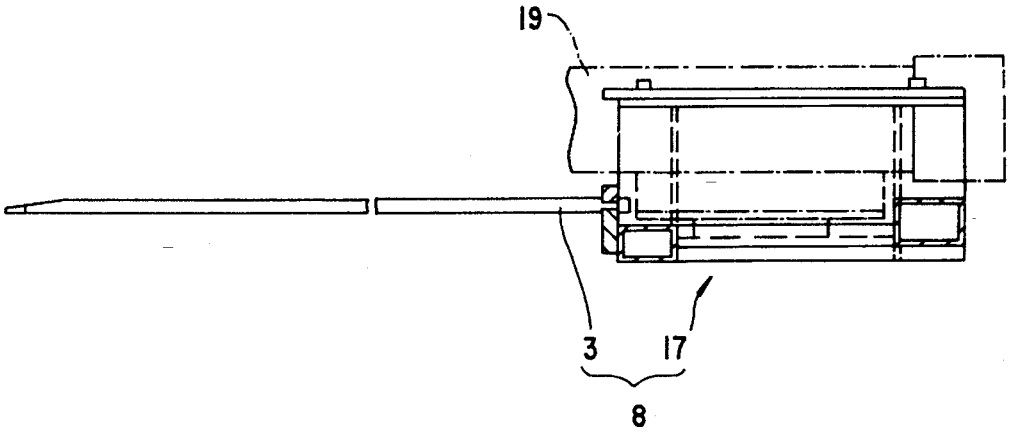
Fig.9
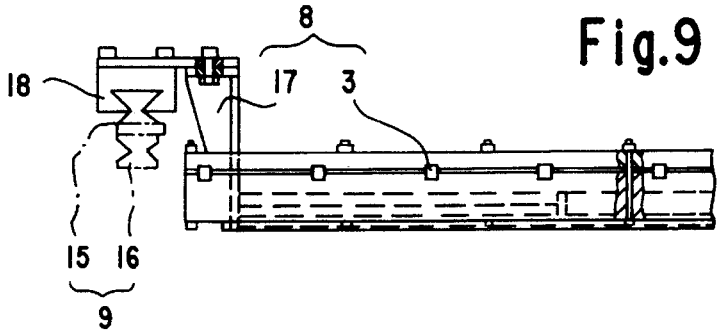
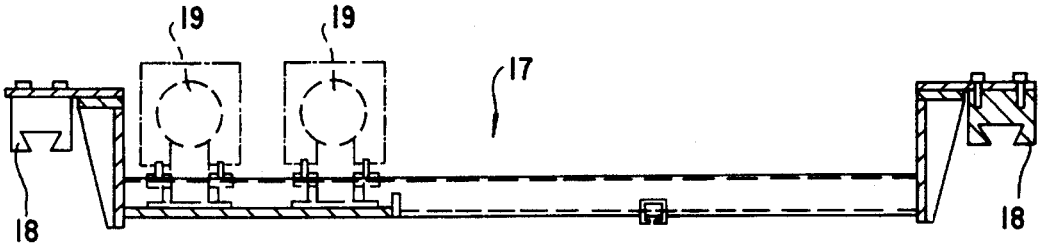
Fig.10

Fig.12
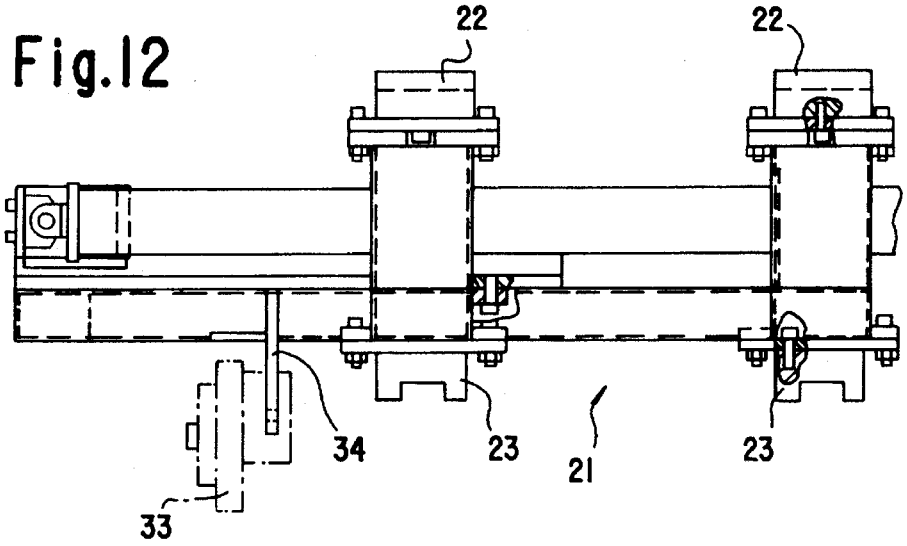
Fig.13
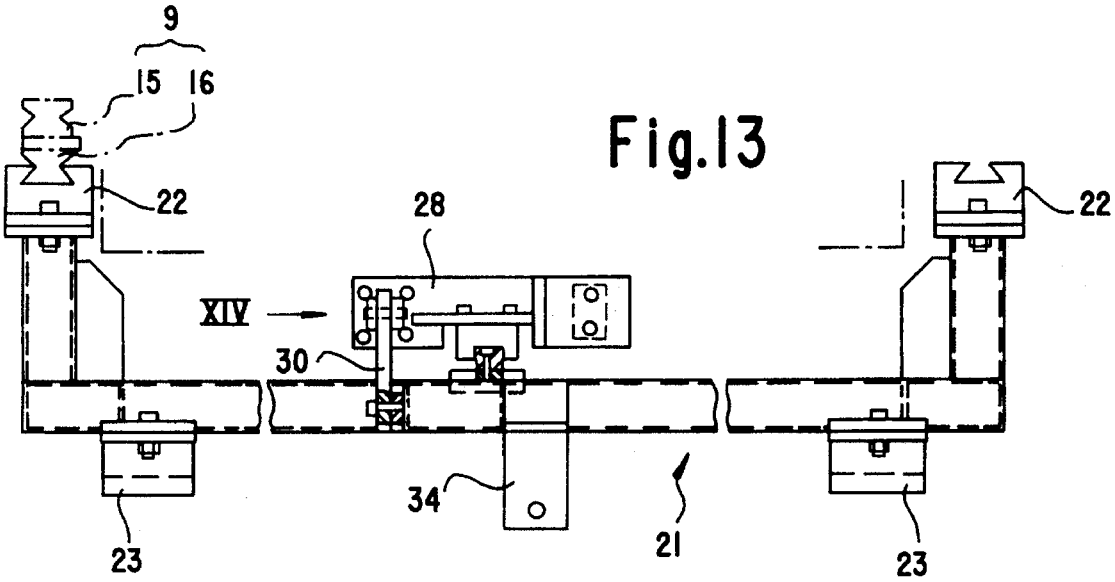
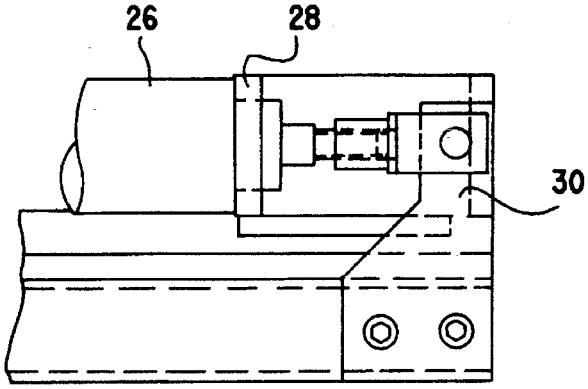
Fig.14

Fig.19
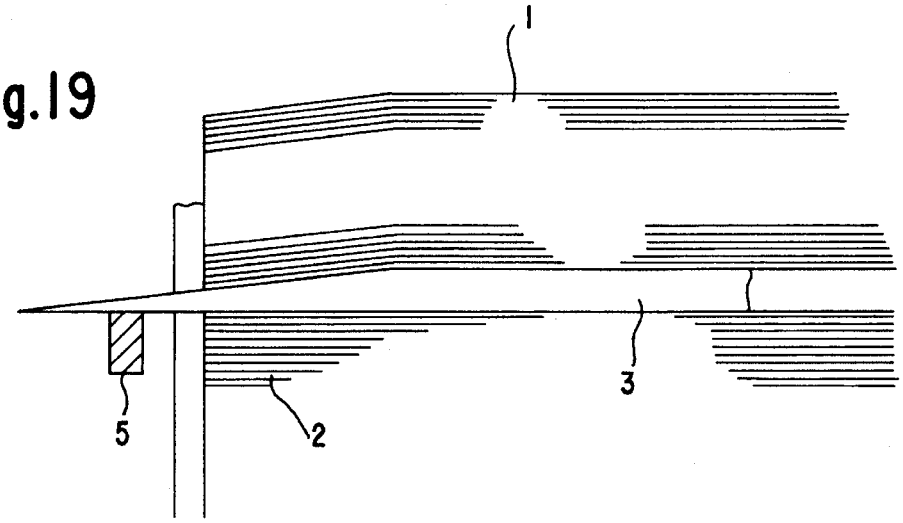
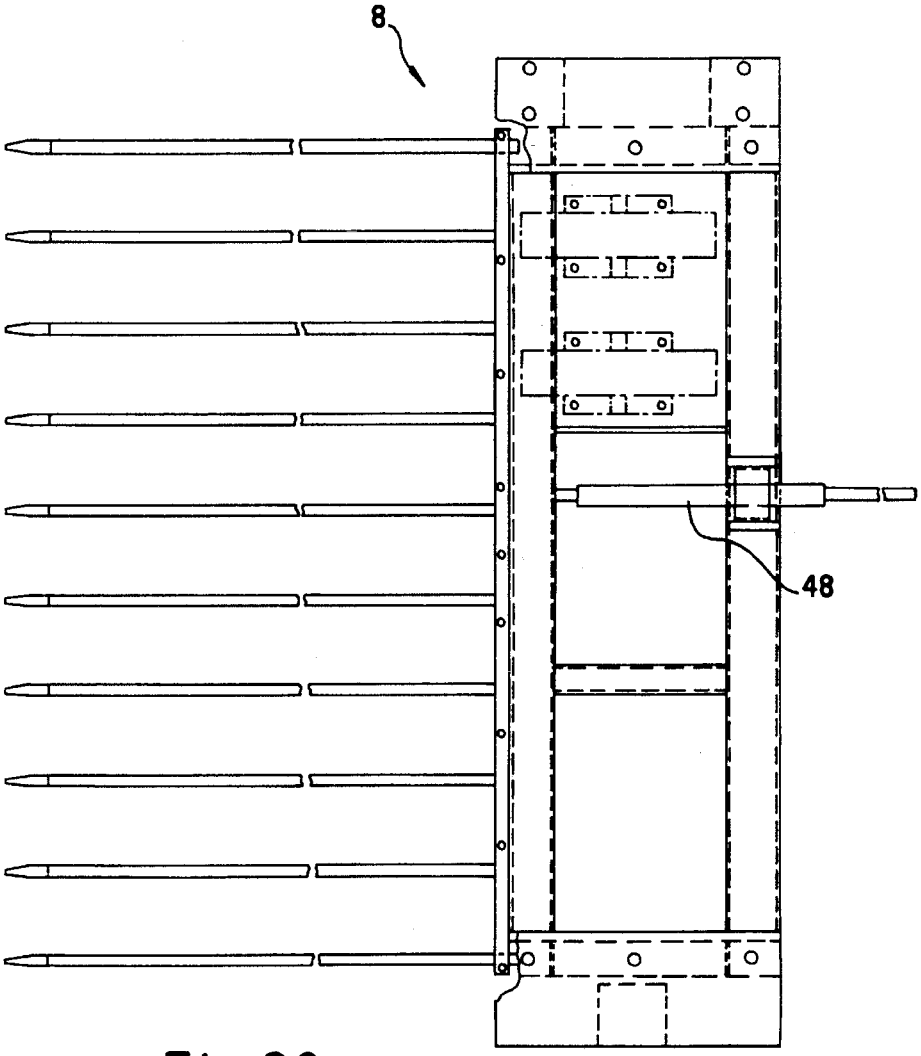
Fig.20

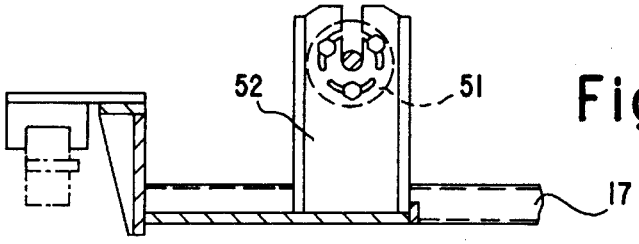
Fig.23
Fig.22
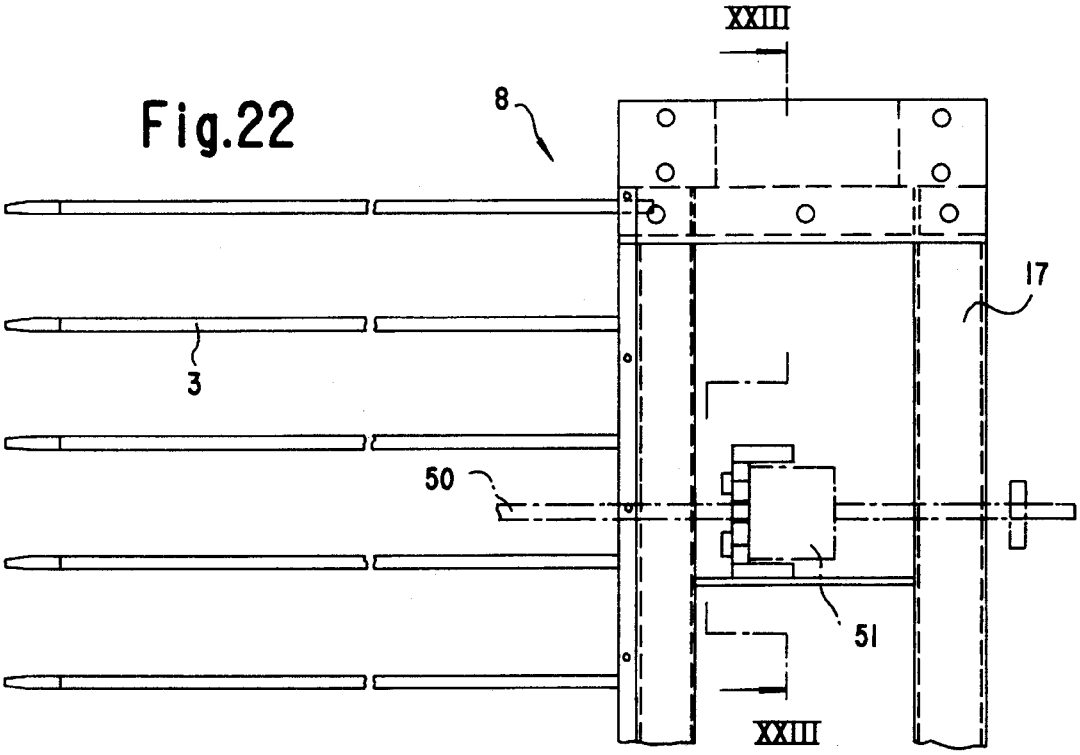
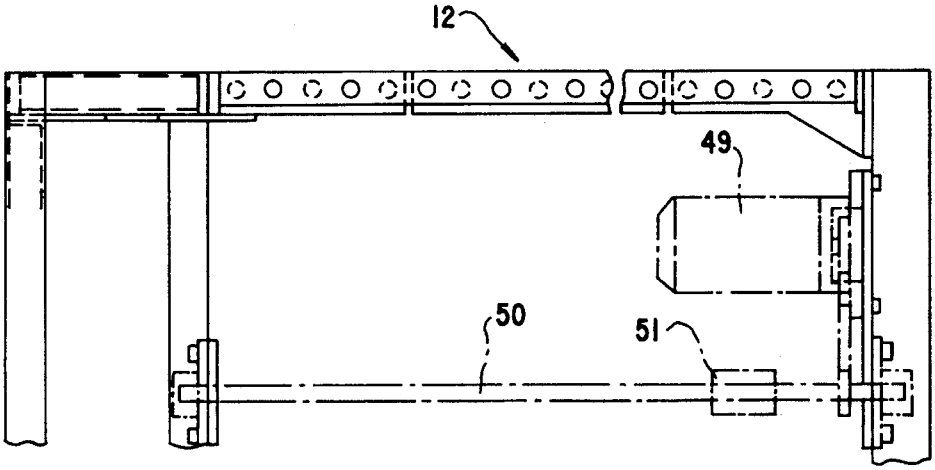
Fig.21

DEVICE FOR UNITING A RESIDUE SHEET PILE AND A MAIN SHEET PILE

This is a continuation of application Ser. No. 08/210,070, filed Mar. 17, 1994, now abandoned; which was a continuation of application Ser. No. 07/939,453, filed Sep. 2, 1992, now abandoned.

The invention relates to a device for uniting a residue sheet pile and a main sheet pile into an aggregate sheet pile wherein a lowermost sheet of the residue sheet pile rests upon an uppermost sheet of the main sheet pile including a displacement device having drive means; a rake displaceable by the displacement device along a displacement path in a pile slide-in direction from a first to a second position and from the second to the first position in a direction opposite to the slide-in direction; the residue sheet pile being seated with its undermost sheet on the rake in the second position thereof, and the main sheet pile being in engagement with the rake from below with the uppermost sheet thereof, in one phase of the pile uniting process; and the rake having traversed the displacement path in the direction from the second to the first position thereof, in a final phase of the pile uniting process; the rake being formed of lattice bars having respective free ends extending in the slide-in direction, and the free bar ends having a cross-section reducing in height substantially constantly in the slide-in direction.

Such a device has become known heretofore, for example, from U.S. Pat. No. 3,180,638. In a phase of the pile uniting process, a gap maintained by the lattice bars is formed between the residue sheet pile and the main sheet pile, in such a device, and closes in the final phase of the pile uniting process during a lowering of the residue sheet pile of about the height of the cross section of the lattice rods. In connection with a lifting mechanism and a detector controlling the latter so that an upper edge of the residue sheet pile is adjusted to a given level, and with an adjustment device for the spacing of a sheet singling or separating device from an upper edge of the sheet pile, as well as a detector for actuating the adjustment device so that the aforementioned spacing is adjusted to a given value, the foregoing lowering of the residue sheet pile has a disadvantageous effect in that, in respective control systems, a disturbance variable increasing suddenly to a relatively high value must be processed.

It is especially disadvantageous, when using a sheet-pile uniting device of the foregoing general type in connection with a sheet feeder of a printing machine, to have a situation arise wherein, in such sheet feeders, the follow-up or control of the aforementioned sheet singling or separating device proceeds more slowly than the level regulation of the height or level of the residue sheet pile. The sagging or sinking of the residue sheet pile in the final phase of the pile uniting operation can lead to breakdown of the printing machine when such use is made of the pile uniting device.

It is accordingly an object of the invention to provide a device for uniting a residue sheet pile and a main sheet pile of the foregoing general type which, when placed in operation with a sheet feeder of a printing machine, for example, will not result in any breakdown of the latter due to the sagging or sinking of the residue sheet pile in the final phase of the pile uniting operation.

With the foregoing and other objects in view, there is provided, in accordance with the invention, a device for uniting a residue sheet pile and a main sheet pile into an aggregate sheet pile wherein a lowermost sheet of the residue sheet pile rests upon an uppermost sheet of the main sheet pile, comprising a displacement device having drive means; a rake displaceable by the displacement device along a displacement path in a pile slide-in direction from a first to a second position and from the second to the first position in a direction opposite to the slide-in direction; the residue sheet pile being seated with its undermost sheet on the rake in the second position thereof, and the main sheet pile being in engagement with the rake from below with the uppermost sheet thereof, in one phase of the pile uniting process; the rake having traversed the displacement path in the direction from the second to the first position thereof, in a final phase of the pile uniting process; the rake being formed of lattice bars having respective free ends extending in the slide-in direction, and the free bar ends having a cross-section reducing in height substantially constantly in the slide-in direction; the reduction in cross section of the free ends of the lattice bars being such that when the residue sheet pile becomes seated on the lattice bars, a lateral face of the residue sheet pile extending in the slide-in direction is simultaneously lowered onto a reduced cross section of the lattice bars.

In accordance with another aspect of the invention, there is provided, a device for uniting a residue sheet pile and a main sheet pile into an aggregate sheet pile wherein a lowermost sheet of the residue sheet pile rests upon an uppermost sheet of the main sheet pile, comprising a displacement device having drive means; a rake displaceable by the displacement device along a displacement path in a pile slide-in direction from a first to a second position and from the second to the first position in a direction opposite to the slide-in direction; the residue sheet pile being seated with its undermost sheet on the rake in the second position thereof, and the main sheet pile being in engagement with the rake from below with the uppermost sheet thereof, in one phase of the pile uniting process; the rake having traversed the displacement path in the direction from the second to the first position thereof, in a final phase of the pile uniting process; the rake being formed of lattice bars having respective free ends extending in the slide-in direction, and the free bar ends having a cross-section reducing in height substantially constantly in the slide-in direction; the drive means of the displacement device being of such construction that the rake, in the final phase of the pile uniting process, traverses the displacement path with speeds following a speed profile which, in at least an end region of the displacement path, has a speed lower than an average speed.

In accordance with a further feature of the invention, the drive means are formed of a cylinder arrangement with which a final-position dampening member for braking the speed of the drive means is coordinated.

In accordance with a concomitant feature of the invention, the drive means are formed of a spindle-drive arrangement with a speed-controlled motor for driving a threaded spindle.

The device according to the invention has the advantage, moreover, that when employed in connection with a sheet feeder of a printing machine, the aforementioned breakdown or other disruptions can be avoided without having to interfere with or adjust the control systems which have been provided theretofore.

Other feature which are considered as characteristic for the invention are set forth in the appended claims.

Although the invention is illustrated and described herein as embodied in device for uniting a residual pile of sheets and a main pile of sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 5 is a side elevational view of FIG. 3 as been in the direction of the arrow 55;

FIG. 6 is a further sectional view of FIG. 3 taken along the line VI—VI in the direction of the arrows;

FIG. 8 is a cross-sectional view of FIG. 7 taken along the line VIII—VIII in the direction of the arrows;

FIG. 9 is a fragmentary side elevational view of FIG. 7 as seen in the direction of the arrow 56;

FIG. 10 is a further sectional view of FIG. 7 taken along the line X—X in the direction of the arrows;

FIG. 12 is a side elevational view of the cross-slide as seen in the direction of arrow 50 in FIG. 11;

FIG. 13 is another side elevational view of the cross-slide as seen in the direction of arrow 51 in FIG. 11;

FIG. 14 is an enlarged fragmentary elevational view as seen in the direction of arrow 52 in FIG. 13;

FIG. 19 is an enlarged fragmentary view of FIG. 1 showing another embodiment of the detail y enclosed in a phantom circle therein;

FIG. 20 is a view like that of FIG. 1 of the rake of another embodiment according to the invention;

FIG. 21 is a fragmentary plan view of the frame supplemented by a spindle-drive arrangement in the other embodiment;

FIG. 22 is a fragmentary view of FIG. 22 showing the rake of the other embodiment supplemented by a spindle-drive arrangement; and FIG. 23 is a sectional view of FIG. 22 taken along the line XXII—XXII in the direction of the arrows.

Figure 1:
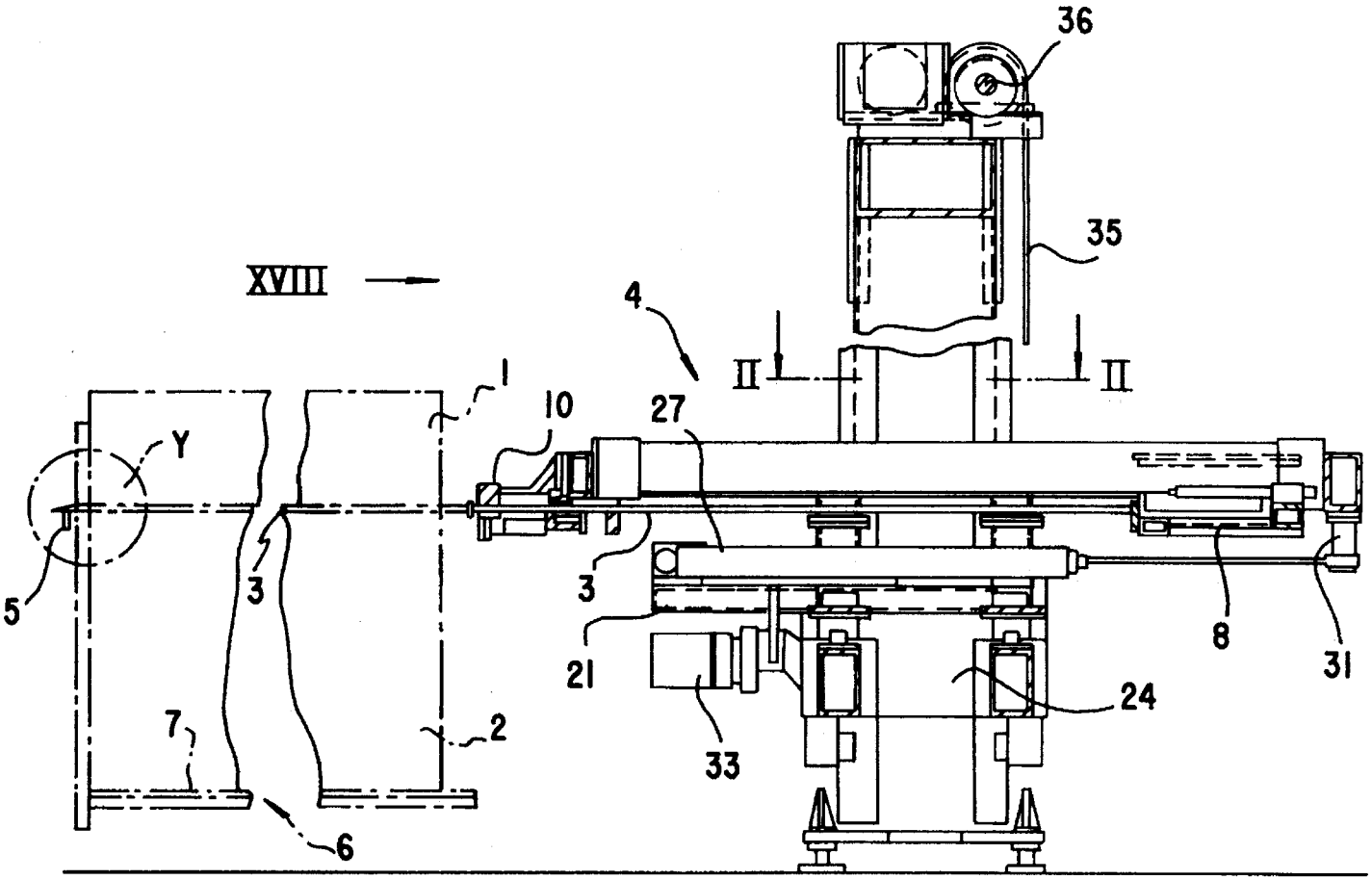
FIG. 1 is a front elevational view of a device for unifying a residual sheet pile and a main sheet pile including a displacement device for a rake and its association with a sheet pile arrangement.

Referring now to the drawings and, first, particularly to FIG. 1 thereof, a pile arrangement is shown therein only diagrammatically and in phantom. A residual pile of sheets 1 and a main pile of sheets 2 are represented in a phase of the pile uniting process wherein the residual pile of sheets 1 is seated with its lowermost sheet on horizontally disposed lattice bars 3 of a displacement device identified as a whole by reference numeral 4 and wherein the main pile of sheets 2 is in contact from below, with the uppermost sheet thereof against the lattice bars 3, the lattice bars 3 being in the position shown in phantom, which is offset in the longitudinal direction of the lattice bars 3 with respect to the position thereof shown in solid lines. The free ends of the lattice bars 3 projecting beyond a side surface of the pile arrangement are supported in a conventional manner by means of an auxiliary traverse or cross-member 5, shown in cross section in FIG. 1.

The main pile 2 is seated with its lowermost sheet on a pile-carrying plate 6. In a sheet feeder of a printing press, a pile of sheets seated on such a pile-carrying plate is raised, during a production run, by means of conventional lifting mechanisms to the same extent as the height of the pile of sheets decreases, until the pile finally becomes a residual pile of sheets. If the displacement device 4, therefore, is installed in conjunction with a sheet feeder of a printing press then, prior to being united with the main pile 2, the residual pile of sheets is initially seated, likewise, with its lowermost sheet on a pile-carrying plate 6 until the pile-carrying plate 6 is removed in a conventional manner by being lowered by the aforementioned lifting mechanisms after the residual pile of sheets 1 has been underpinned by means of the lattice bars 3. Mutually parallel grooves 7 are formed, in a conventional manner, on the horizontally aligned upper side of the pile-carrying plate 6. A group of the mutually parallel lattice bars 3 is assembled to form a rake 8, the cross sections of the lattice bars 3 and of the grooves 7 being so coordinated that the lattice bars 3 can be inserted, in the longitudinal direction thereof, into the grooves 7 so that, in a phase of the uniting process, the residual pile of sheets 1 is underpinned by the lattice bars 3.

In order to displace the lattice bars 3 in the longitudinal direction thereof, guide rails 9 on which the rake 8 is displaceably held are provided for this purpose in the displacement device 4.

Figure 4:
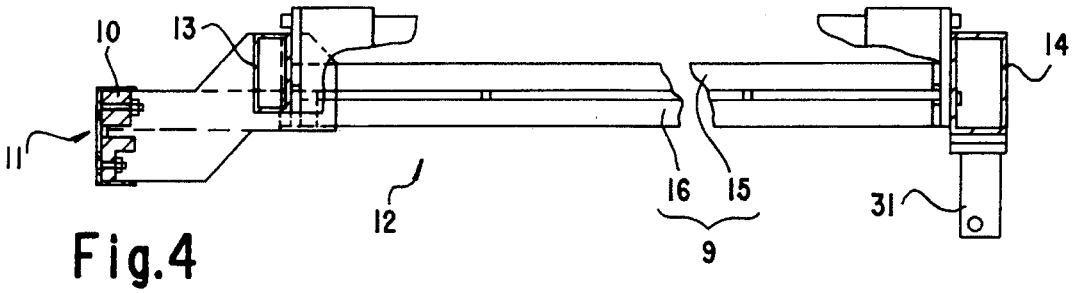
FIG. 4 is a sectional view of FIG. 3 taken along the line IV—IV in the direction of the arrows.

The phase of the uniting process shown in FIG. 1, with a view of the mutual positions of the residual pile 1, the main pile 2 and the lattice bars 3 enclosed therebetween, is followed, in a final phase of the uniting process, by the removal of the lattice bars 3 from the illustrated pile arrangement, in a removal direction towards the right-hand side of FIG. 1. In order to prevent sheets which are in the vicinity of the lattice bars 3 from being displaced likewise in the removal direction, a conventional stop rail 10 is provided which extends transversely to the longitudinal direction of the lattice bars 3 and is displaceable in the longitudinal direction of the lattice bars 3, the stop rail 10 being formed with penetrations 11 discernible in FIGS. 4 and 5 for affording passage of the lattice bars 3 through the stop rail 10.

Figure 2:
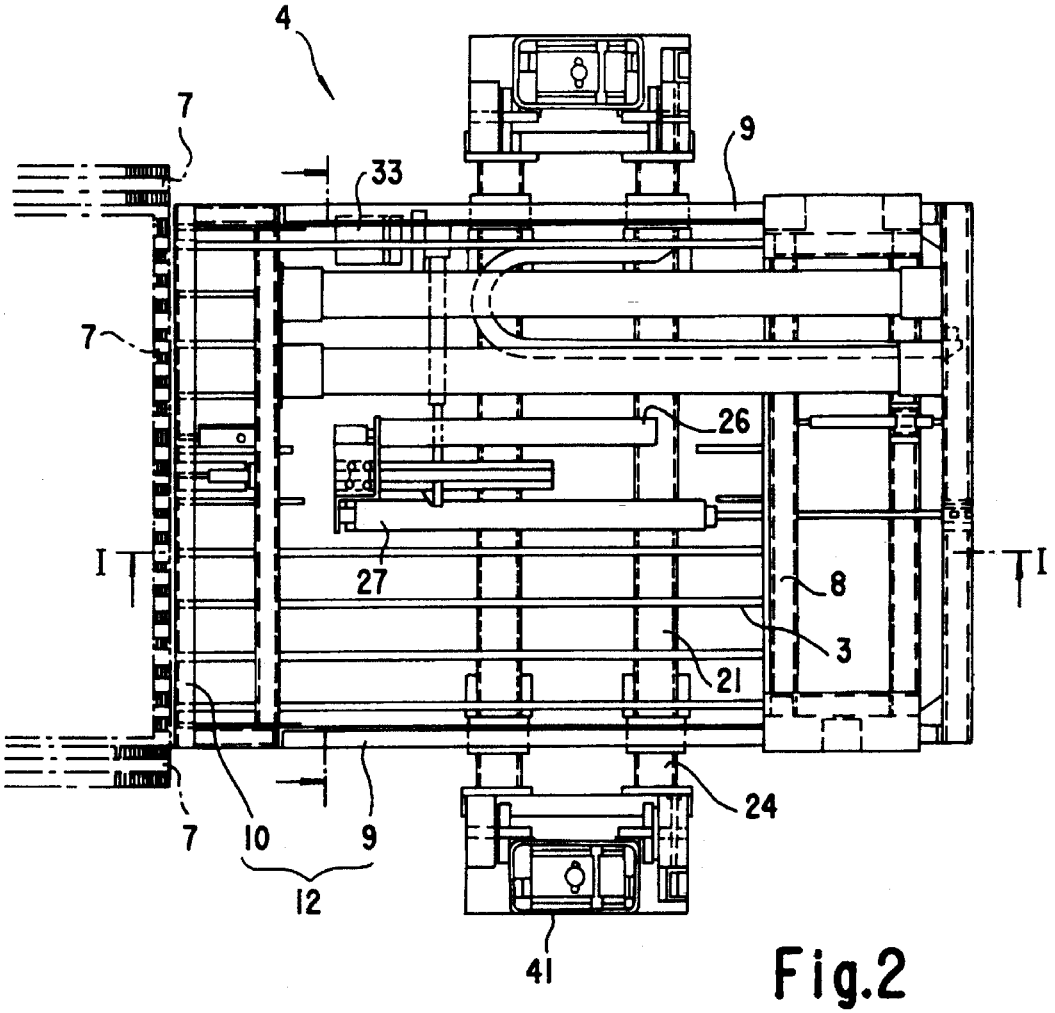
FIG. 2 is an enlarged cross-sectional view of FIG. 1 taken along the line II—II in the direction of the arrows.

As is apparent from FIG. 2, the guide rails 9, respectively, form a side part of a frame 12, and the stop rail 10 forms an end or front leg of the frame 12.

Figure 3:
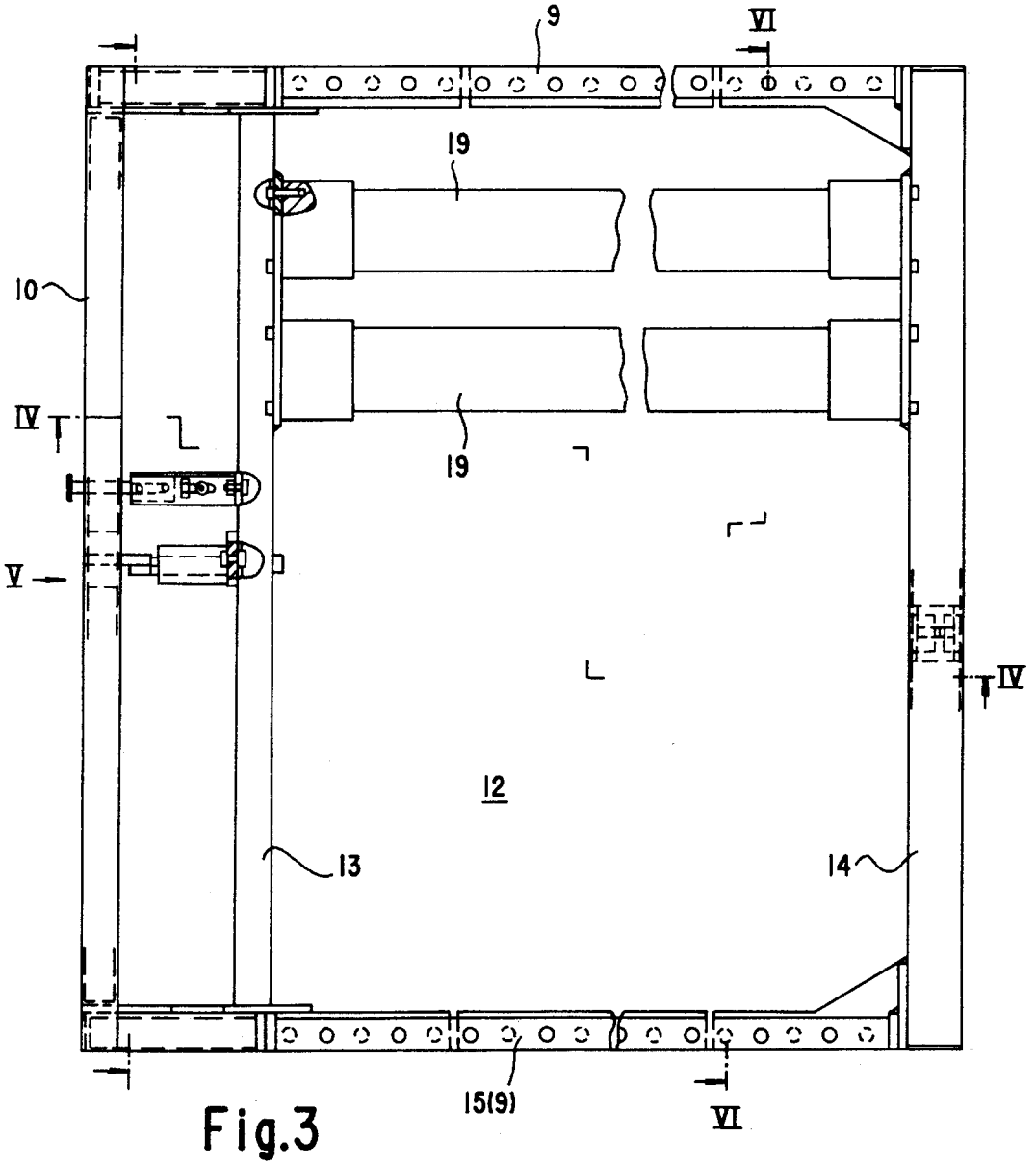
FIG. 3 is a much-enlarged fragmentary view of FIG. 2 showing a frame removed from the displacement device of FIG. 2.

The frame 12, which is shown in FIG. 3 removed from the displacement device 4 and in a position corresponding to the position thereof shown in FIG. 2, is additionally stiffened by means of a first cross-strut 13 at a front end (situated at the left-hand side of FIG. 3) and by means of a second cross-strut 14 at a rear end of the guide rail 9 (situated at the right-hand side of FIG. 3).

Figure 7:
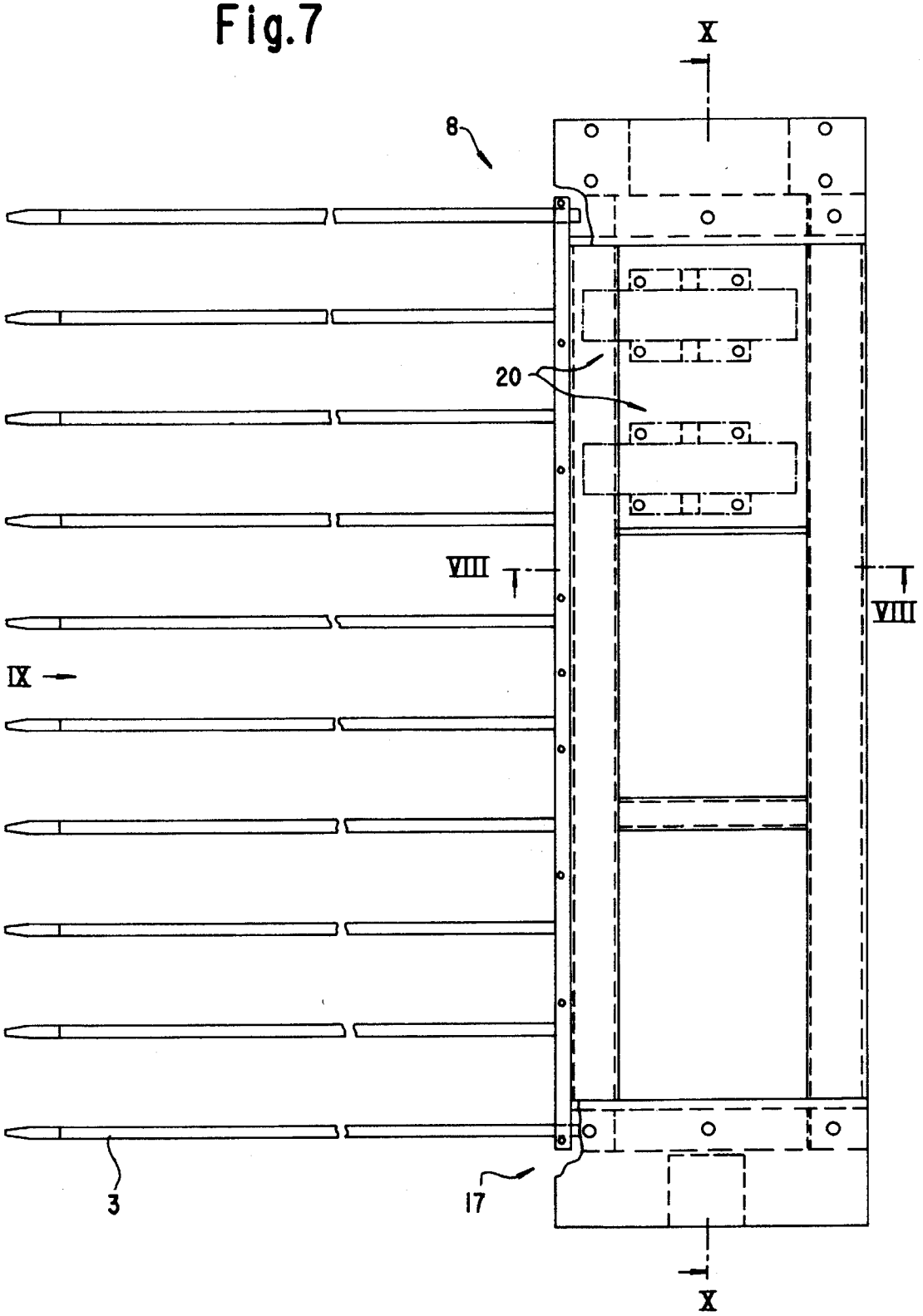
FIG. 7 is a top plan view of a rake, removed from the displacement device of FIG. 2.

As can be seen from FIG. 6, each guide rail 9 is assembled of an upper guide bar 15 and of a lower guide bar 16, the upper guide bar 15 serving as a straight guide for the rake 8, which is shown in FIG. 7 removed from the displacement device 4 and in a position corresponding to the position thereof in FIG. 2. The rake 8 is formed by a bridge 17 in which the lattice bars 3 are clamped by one of the ends thereof, respectively, as can be seen most clearly in FIG. 8. The bridge 17 extends transversely to the longitudinal direction of the lattice bars 3 and has bridge bearings in the form of straight guide sections or profiles 18, each of which embraces an upper guide bar 15 of one of the guide rails 9. FIG. 9 shows how the straight guide sections 18 are connected to an upper guide bar 15, with the upper and lower guide bars 15 and 16 each being represented in phantom. The guide rails 9 and the lattice bars 3 extend parallel to one another, so that the rake 8 is supported in a manner that it is displaceable with respect to the frame 12 in the longitudinal direction of the lattice bars 3.

Drive means for displacing the rake 8 with respect to the frame 12 are installed in the form of band cylinders 19 between the first and the second cross-struts 13 and 14 of the frame 12 and oriented parallel to the guide rails 9, the band cylinders 19, as indicated in phantom in FIG. 10, having bands which are connected to the bridge 17 of the rake 8. In FIG. 7, corresponding connecting means 20 for connecting the bands of the band cylinders 19 to the bridge 17 are shown diagrammatically and in phantom.

The frame 12, in turn, is mounted within the displacement device so that it is displaceable in the longitudinal direction of the lattice bars 3 and in a horizontal plane transverse to the longitudinal direction of the lattice bars 3. The displacement device is equipped with a cross-slide 21 for this purpose.

Figure 11:
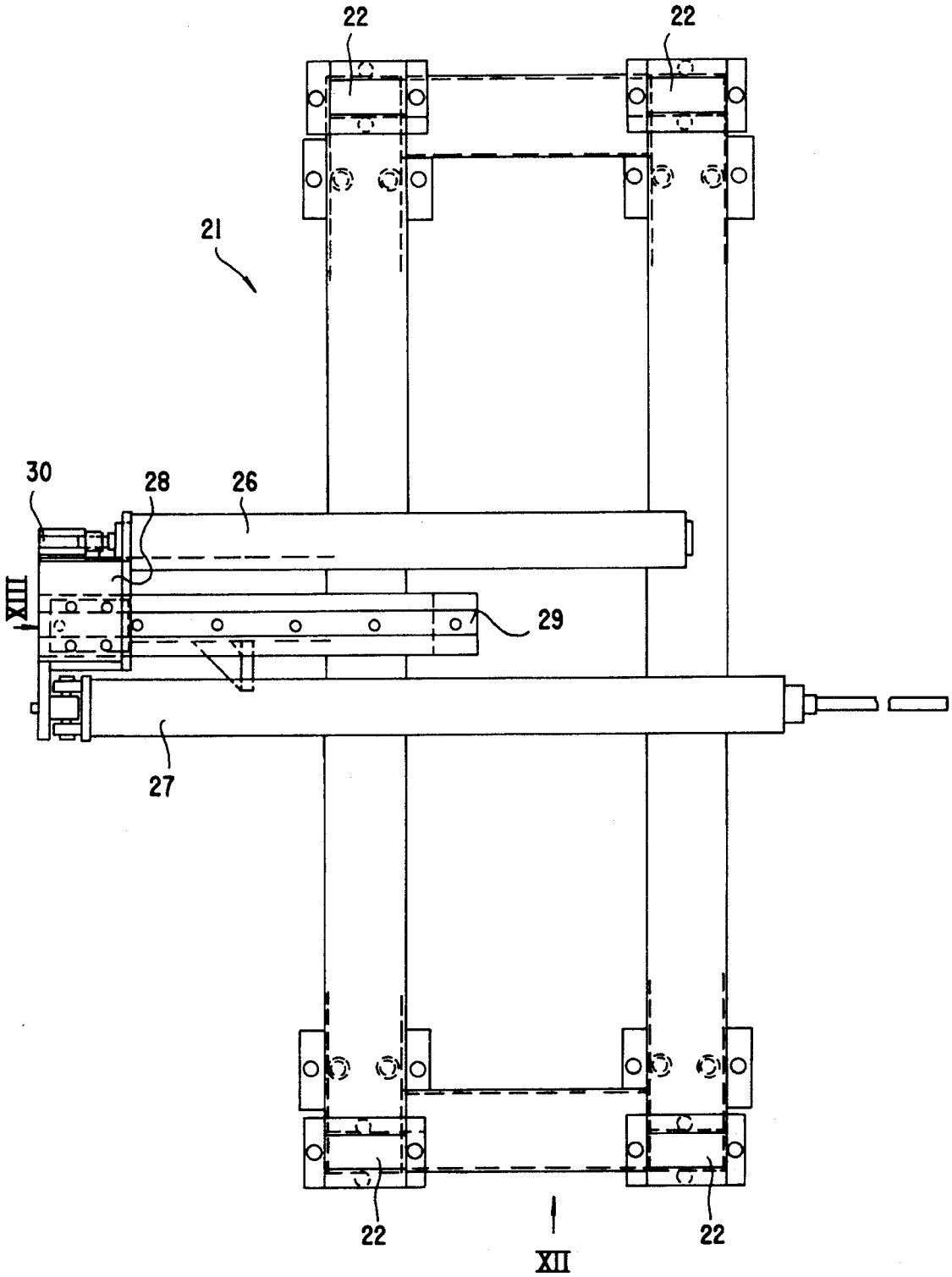
FIG. 11 is a top plan view of a cross-slide removed from the device of FIG. 2.
Figure 16:
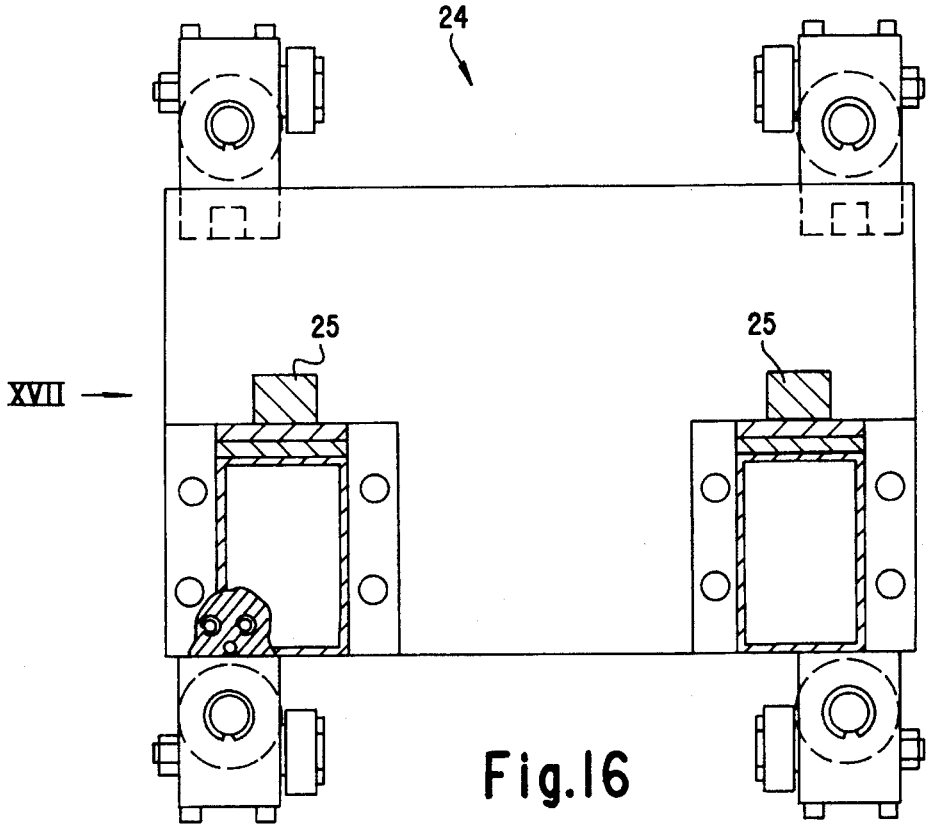
FIG. 16 is a sectional view of FIG. 15 taken along the line XVI—XVI in the direction of the arrows.

The cross-slide 21, which is illustrated in FIG. 11 removed from the displacement device 4 and in a position corresponding to the position thereof shown in FIG. 2, extends transversely to the lattice bars 3 from a guide rail 9 on a first longitudinal side of the frame 12 to the opposite guide rail 9 on a second longitudinal side of the frame 12, and has straight guide sections 22 corresponding to the straight guide sections 18 (FIGS. 9 and 10) provided on the rake 8. These straight guide sections 22 embrace a respective lower guide bar 16 of a respective guide rail 9. Thus, the frame 12 forms a first slide of a telescopic slide, the first slide being guided by the cross-slide 21 in the longitudinal direction of the lattice bars 3, a second slide of the telescopic slide being represented by the rake 8 which is displaceable likewise in the longitudinal direction of the lattice bars 3.

The cross-slide 21 is equipped with other straight guide sections 23 oriented transversely with respect to the lattice bars 3 (note FIGS. 12 and 13). The straight guide sections 23 will be discussed hereinafter in greater detail.

The displacement device 4, furthermore, has a slide-guiding bed 24. The slide-guiding bed 24 shown in FIG. 15, removed from the displacement device 4 and disposed in a position corresponding to the position thereof in FIG. 2, is provided with horizontally extending straight-guide tracks 25 oriented transversely to the lattice bars 3 and being in engagement with straight-guide sections or profiles 23 provided on the cross-slide 21. Consequently, the cross-slide 21 is disposed so at to be horizontally displaceable transversely to the longitudinal direction of the lattice bars 3.

The illustrated embodiment of the invention provides for the independent displacement of the frame 12 with respect to the cross-slide 21. In this regard, a piston-cylinder arrangement is provided which includes a first cylinder 26 and a second cylinder 27 and which acts between the cross-slide 21, on the one hand, and the frame 12, on the other hand. The first cylinder 26 is flanged onto a guide head 28, which is guided by means of a slideway 29 oriented in the longitudinal direction of the lattice bars 3 and attached to the cross-slide 21, while the piston rod of the first cylinder 26 is swivel-mounted on a strap 30 attached to the cross-slide 21 (see FIG. 11, 13 and 14). The second cylinder 27 is articulatingly mounted at its one end on the guide head 28, while the end of the piston rod of the second cylinder 27 facing away from the one end is connected in an articulating manner to a further strap 31 (note FIG. 1, for example), which, in turn, is attached to the frame 12.

Figure 15:
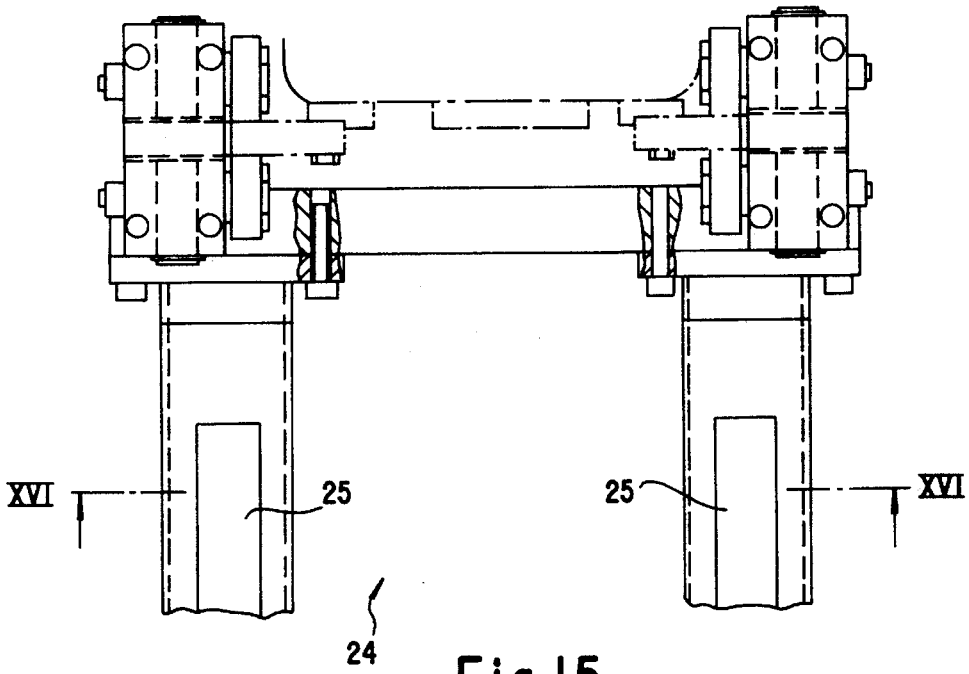
FIG. 15 is a much-enlarged fragmentary view of FIG. 2 showing a cross-member arrangement thereof removed from the displacement device.
Figure 17:
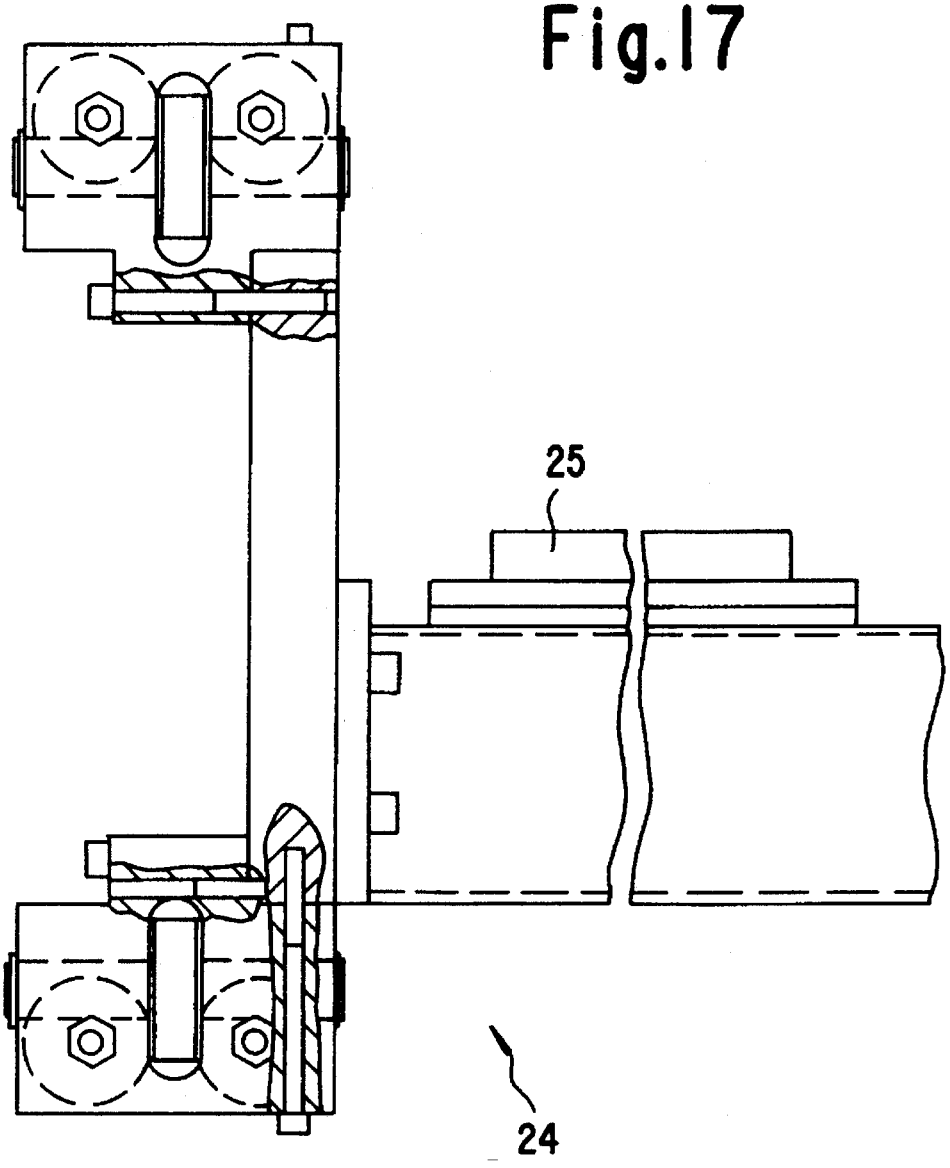
FIG. 17 is a side elevational view of the cross-member arrangement as seen in the direction of arrow 53 in FIG. 16.
Figure 18:
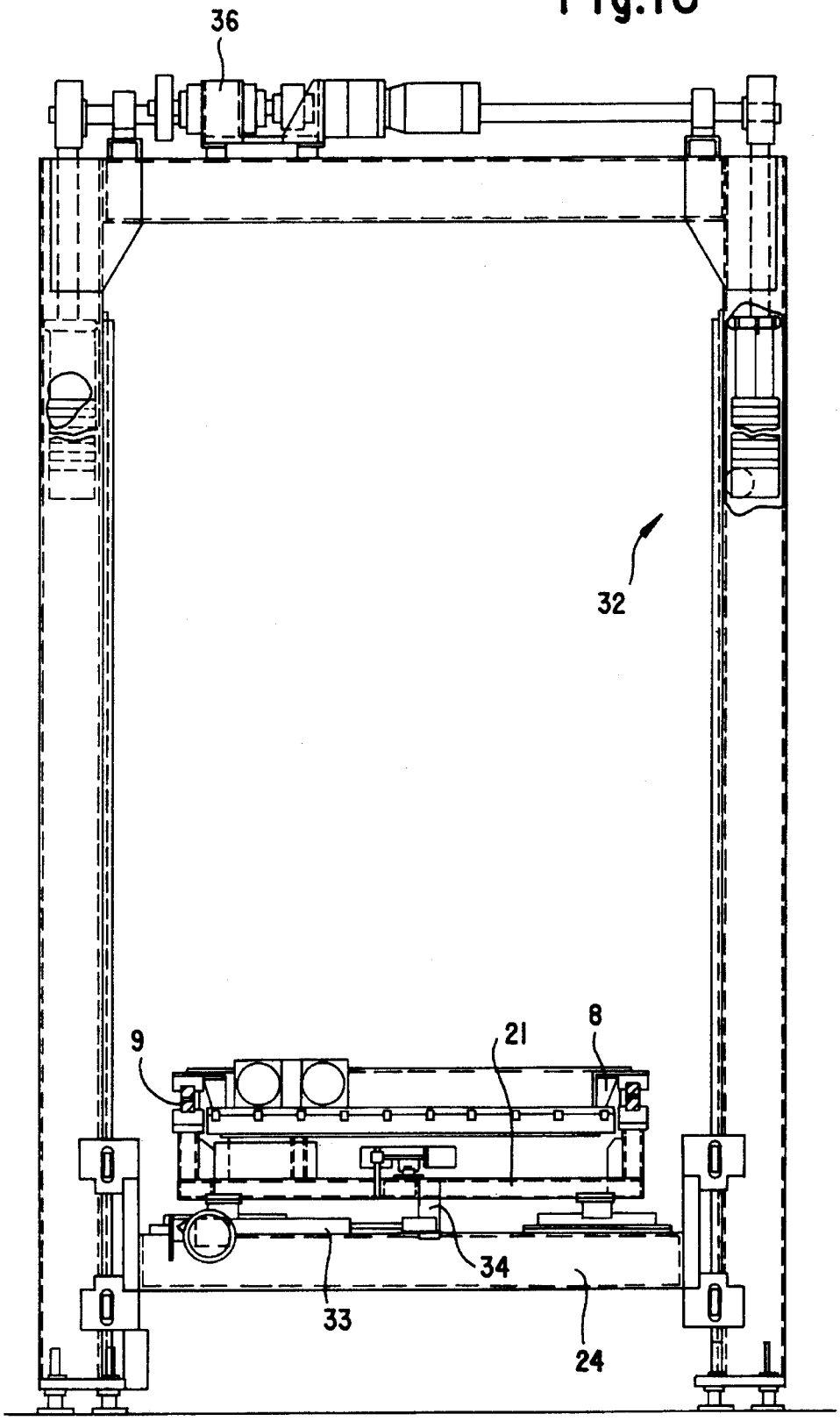
FIG. 18 is an elevational view of the device according to the invention as seen the the direction of arrow 54 in FIG. 1.

The slide-guiding bed 24, as shown in FIGS. 15 and 17, is in the form of a lift truck which can be moved vertically along a lifting cradle 32 (note FIG. 18). In order to move the lift truck along the lifting cradle 32, the slide-guiding bed 24 is connected to a lifting drive 36 through the intermediary of traction means 35, such as a chain or a toothed belt (note FIG. 1).

The aforedescribed embodiment of the invention further provides for an independent displacement of the cross-slide 21 with respect to the slide-guiding bed 24. For this purpose, a linear servo-drive 33 is mounted on the side-guiding bed 24 and a pushrod of the linear servo-drive 33 is articulatingly connected to another strap 34 which is fastened to the cross-slide 21.

As shown in FIG. 19, in another embodiment of the hereinaforedescribed device, the free ends of the lattice bars 3 are formed with such a reducing cross section that, simultaneously with the placement of the residual sheet pile 1 on the lattice bars 3, a lateral face 1.1 of the residual pile 1 extending in the slide-in direction lowers onto a reduced cross section of the lattice bars 3. With this measure, the control operations for setting the aforementioned adjustment device are divided into two steps which follow one another with marked time intervals during the ordinary course of uniting the residual sheet pile 1 with the main sheet pile 2 with the aid of the hereinaforedescribed device according to the invention, only a considerably smaller disturbance variable occurring for each of the steps.

In accordance with a further embodiment of the invention, there are provide drive means which are constructed for displacing the rake 3 so that, in the final phase of uniting the sheet piler, the rake 8 traverses its displacement path with speeds which follow a speed profile which, at the least in an end region of the displacement path, has a speed lower than an average speed.

In an embodiment of the invention according to FIG. 20, a damping cylinder 48 is provided on the rake 8 for braking the speed of the bands of the band cylinder 19 along a final length of the displacement path of the rake 8 covered opposite to the slide-in direction. In this regard, the free end of the piston rod of the damping cylinder 48 during the aforementioned final length of the displacement path of the rake 8 is braced on the cross-strut 14 of the frame 12 (note FIGS. 1 and 3).

Instead of the damping cylinder 48, in yet another embodiment of the invention, for displacing the rake 8, a spindle-drive arrangement with a speed-controlled motor 49 is provided. The motor 49 and a threaded spindle 50 driven thereby are arranged on the frame 12 (note FIG. 21). The threaded spindle 50 engages in a spindle nut 51 which is connected, so as to be fixed against rotation, to a guide plate 52 fastened to the bridge 17 of the rake 8 (note FIG. 23). With this embodiment of the invention, the aforementioned speed profile regarding a respective control of the speed of the motor 49 is attained.

We claim:

1. Device for carrying out a pile uniting process including several phases, in which a residue sheet pile seated on a first pile support and a main sheet pile seated on a second pile support are united into an aggregate sheet pile wherein a lowermost sheet of the residue sheet pile rests upon an uppermost sheet of the main sheet pile, the device comprising a displacement device having drive means; a rake displaceable by said displacement device along a displacement path in a pile slide-in direction from a first to a second position and from said second to said first position in a direction opposite to said slide-in direction; said rake being formed of lattice bars having respective free ends extending in said slide-in direction, and said free bar ends each having a cross-section reducing in height substantially constantly in said slide-in direction; said first and said second pile support each having a flat pile support surface interrupted by grooves adapted to fully accommodate said lattice bars; said lattice bars being inserted into said grooves in one of said phases while said rake is being moved along said displacement path into said second position, and being adapted to replace said first pile support in a further one of the phases; said main sheet pile being in engagement with said lattice bars from below with said uppermost sheet thereof, in another one of said phases of the pile uniting process; said rake having traversed said displacement path in the direction from said second to said first position thereof, in a final one of the phases of the pile uniting process; said lowermost sheet of said residue sheet pile coming to be seated on said lattice bars and a lateral face of said residue sheet pile extending in said slide-in direction being simultaneously lowered onto a reduced cross section of said lattice bars in said further phase of said pile uniting process.

2. Device for uniting a residue sheet pile and a main sheet pile into an aggregate sheet of pile wherein a lowermost sheet of the-residue sheet pile rests upon an uppermost sheet of the main sheet pile comprising a displacement device having drive means; a rake displaceable by said displacement device along a displacement path in a pile slide-in direction from a first to a second position and from said second to said first position in a direction opposite to said slide-in direction; the residue sheet pile being seated with its undermost sheet on said rake in said second position thereof, and said main sheet pile being in engagement with said rake from below with said uppermost sheet thereof, in one phase of the pile uniting process; said rake having traversed said displacement path in the direction from said second to said first position thereof, in a final phase of the pile uniting process; said rake being formed of lattice bars having respective free ends extending in said slide-in direction, and said free bar ends having a cross-section reducing in height substantially constantly in said slide-in direction; said drive means of said displacement device being of such construction that said rake, in the final phase of the pile uniting process, traverses said displacement path with speeds following a speed profile which, in at least an end region of said displacement path, has a speed lower than an average speed, said drive means being formed of a cylinder arrangement with which a final-position damping member for braking the speed of said drive means is coordinated.

3. Device for uniting a residue sheet pile and a main sheet pile into an aggregate sheet pile wherein a lowermost sheet of the residue sheet pile rests upon an uppermost sheet of the main sheet pile comprising a displacement device having drive means; a rake displaceable by said displacement device along a displacement path in a pile slide-in direction from a first to a second position and from said second to said first position in a direction opposite to said slide-in direction; the residue sheet pile being seated with its undermost sheet on said rake in said second position thereof, and said main sheet pile being in engagement with said rake from below with said uppermost sheet thereof, in one phase of the pile uniting process; said rake having traversed said displacement path in the direction from said second to said first position thereof, in a final phase of the pile uniting process; said rake being formed of lattice bars having respective free ends extending in said slide-in direction, and said free bar ends having a cross-section reducing in height substantially constantly in said slide-in direction; said drive means of said displacement device being of such construction that said rake, in the final phase of the pile uniting process, traverses said displacement path with speeds following a speed profile which, in at least an end region of said displacement path, has a speed lower than an average speed, said drive means being formed of a spindle-drive arrangement with a speed-controlled motor for driving a threaded spindle.

* * * * *